US008794615B2

(12) United States Patent
Kato et al.

(10) Patent No.: US 8,794,615 B2
(45) Date of Patent: Aug. 5, 2014

(54) SHEET POST-PROCESSING APPARATUS THAT PERFORMS POST-PROCESSING ON SHEET BUNDLE, METHOD OF CONTROLLING THE SAME, AND STORAGE MEDIUM

(71) Applicant: Canon Kabushiki Kaisha, Tokyo (JP)

(72) Inventors: Hitoshi Kato, Toride (JP); Naoki Ishikawa, Kashiwa (JP)

(73) Assignee: Canon Kabushiki Kaisha (JP)

( * ) Notice: Subject to any disclaimer, the term of this patent is extended or adjusted under 35 U.S.C. 154(b) by 37 days.

(21) Appl. No.: 13/682,858

(22) Filed: Nov. 21, 2012

(65) Prior Publication Data

US 2013/0134645 A1 May 30, 2013

(30) Foreign Application Priority Data

Nov. 28, 2011 (JP) ..... 2011-258772

(51) Int. Cl.
*B65H 37/06* (2006.01)

(52) U.S. Cl.
USPC ..... 270/45; 270/32; 270/58.09; 399/410

(58) Field of Classification Search
CPC ..... B65H 37/04
USPC ..... 270/58.08, 58.09, 58.11, 58.12; 399/410
See application file for complete search history.

(56) References Cited

U.S. PATENT DOCUMENTS

| | | | | |
|---|---|---|---|---|
| 7,255,340 | B2 * | 8/2007 | Anezaki et al. | 271/176 |
| 7,413,178 | B2 * | 8/2008 | Fujii et al. | 270/58.11 |
| 7,584,948 | B2 * | 9/2009 | Fujii et al. | 270/58.11 |
| 7,644,919 | B2 * | 1/2010 | Sato | 271/226 |
| 7,891,652 | B2 * | 2/2011 | Mandel et al. | 270/58.17 |
| 7,946,564 | B2 * | 5/2011 | Iguchi et al. | 270/37 |
| 7,980,544 | B2 * | 7/2011 | Baba et al. | 270/58.11 |
| 8,226,077 | B2 * | 7/2012 | Iguchi et al. | 270/37 |
| 8,398,067 | B2 * | 3/2013 | Furuhashi et al. | 270/58.11 |
| 8,505,903 | B2 * | 8/2013 | Hattori | 270/45 |
| 8,596,631 | B2 * | 12/2013 | Ishikawa et al. | 270/51 |
| 2011/0266738 | A1 * | 11/2011 | Furuhashi et al. | 270/58.08 |

FOREIGN PATENT DOCUMENTS

JP 2006-290588 A 10/2006

* cited by examiner

*Primary Examiner* — Patrick Mackey
(74) *Attorney, Agent, or Firm* — Rossi, Kimms & McDowell LLP

(57) ABSTRACT

A sheet post-processing apparatus capable of stably stopping a clamping member at a predetermined target position (holding position), of performing post-processing regardless of thickness of a sheet bundle. A holding member is used for holding a sheet bundle. A moving unit moves the holding member between a predetermined reference position and a predetermined holding position at which the holding member holds the sheet bundle. A sheet post-processing unit performs post-processing on the sheet bundle held by the holding member. A control unit configured to, when the holding member is moved from the reference position and is stopped at the holding position by the moving unit, decelerate a moving speed of the moving unit, before performing a stopping process of the moving unit, such that a deceleration rate of the moving speed is smaller as a thickness of the sheet bundle is larger.

18 Claims, 8 Drawing Sheets

SHEET POST-PROCESSING APPARATUS THAT PERFORMS POST-PROCESSING ON SHEET BUNDLE, METHOD OF CONTROLLING THE SAME, AND STORAGE MEDIUM

BACKGROUND OF THE INVENTION

1. Field of the Invention

The present invention relates to a sheet post-processing apparatus for performing post-processing on a fold portion of a sheet bundle, a method of controlling the same, and a storage medium.

2. Description of the Related Art

In general, a post-processing apparatus is known which performs post-processing on a sheet (recording paper) having an image formed thereon. In this sheet post-processing apparatus, for example, sheets each having an image formed thereon are accumulated (stacked) and formed into a sheet bundle. Then, for example, the sheet post-processing apparatus staples a center in the sheet conveying direction or its vicinity of the sheet bundle and then delivers the sheet bundle in a booklet form after folding the same into two at the stapled portion. This post-processing is called saddle stitch bookbinding.

When performing saddle stitch bookbinding, for example, the sheet bundle subjected to stapling is pushed into a nip between a pair of fold rollers by thrusting the central portion of the sheet bundle using a thrusting member. Then, the sheet bundle is folded by the pair of fold rollers. Further, a folded portion of the sheet bundle is flattened by a flattening mechanism (see Japanese Patent Laid-Open Publication No. 2006-290588).

In the flattening mechanism of the sheet post-processing apparatus described in Japanese Patent Laid-Open Publication No. 2006-290588, a press roller is moved along a fold line of the folded portion while flattening the folded portion by the press roller, whereby the folded portion is flattened. Further, during flattening of the folded portion including the fold line, a clamper holds the sheet bundle so as to prevent the sheet bundle from returning toward the upstream side in the conveying direction.

The clamper for holding the sheet bundle holds the sheet bundle generally by pressure (biasing force) of a biasing member, such as a spring. Therefore, the clamper includes the spring, a clamping member, and a moving member, and the spring is disposed between the moving member and the clamping member.

In holding the sheet bundle, the moving member is moved toward the sheet bundle, whereby the clamping member is moved. And, after the clamping member reaches the sheet bundle, the moving member is further moved to compress the spring to create a spring force, whereby the created spring force causes the clamping member to hold the sheet bundle.

Incidentally, the thickness of the sheet bundle increases as the number of sheets of the sheet bundle is larger or as the basis weight of each sheet is larger. And, even if the amount of movement of the moving member is the same, the amount of compression of the spring increases as the thickness of the sheet bundle increases. If the compression of the spring increases, load applied to a drive source (e.g. motor) for driving the moving member increases. As a result, a braking distance becomes shorter over which the moving member is moved before it is stopped after the brake is applied to the motor.

However, if the braking distance becomes shorter, the moving member is stopped short of a target stopping position (target position). This sometimes makes the compression of the spring smaller than required, thereby making it impossible to obtain a sufficient holding force of the clamper. If it is impossible to obtain a sufficient holding force, i.e. if the holding force is insufficient, when the folded portion is flattened, the sheet bundle is pushed back toward the upstream side in the conveying direction, which makes it impossible to sufficiently flatten the folded portion.

If brake timing is delayed or moving speed of the clamp is accelerated so as to stop the clamping member at the target position for the purpose of holding a sheet bundle formed of a large number of sheets, in the case of a sheet bundle formed of a small number of sheets, the thickness of this sheet bundle is thin, and hence the load applied to the motor is small, making the braking distance longer, which sometimes causes the moving member to reach a limit position of movement thereof. If the limit position of movement of the moving member is reached, a driving section, such as the motor, is locked, causing a failure of the apparatus.

SUMMARY OF THE INVENTION

The present invention provides a sheet post-processing apparatus capable of performing post-processing by stably stopping a clamping member at a predetermined target position (holding position) irrespective of the thickness of a sheet bundle, a method of controlling the same, and a storage medium.

In a first aspect of the present invention, there is provided a sheet post-processing apparatus comprising a holding member configured to be used for holding a sheet bundle, a moving unit configured to move the holding member between a predetermined reference position and a predetermined holding position at which the holding member holds the sheet bundle, a sheet post-processing unit configured to perform post-processing on the sheet bundle held by the holding member, and a control unit configured to, after the holding member is moved from the reference position by the moving unit, decelerate a moving speed of the moving unit, before performing a stopping process for stopping the moving unit so as to position the holding member at the holding position, such that a deceleration rate of the moving speed is smaller as a thickness of the sheet bundle is larger.

In a second aspect of the present invention, there is provided a sheet post-processing apparatus comprising a holding member configured to be used for holding a sheet bundle, a moving unit configured to move the holding member between a predetermined reference position and a predetermined holding position at which the holding member holds the sheet bundle, a sheet post-processing unit configured to perform post-processing on the sheet bundle held by the holding member, and a control unit configured to, after the holding member is moved from the reference position by the moving unit, make timing of stopping the moving unit so as to position the holding member at the holding position later as a thickness of the sheet bundle is larger.

In a third aspect of the present invention, there is provided a method of controlling a sheet post-processing apparatus including a holding member configured to be used for holding a sheet bundle, a moving unit configured to move the holding member between a predetermined reference position and a predetermined holding position at which the holding member holds the sheet bundle, and a sheet post-processing unit configured to perform post-processing on the sheet bundle held by the holding member, the method comprising moving the holding member from the predetermined reference position using the moving unit, and decelerating a moving speed of the moving unit, before performing a stopping process for stopping the moving unit so as to position the holding member at the holding position, such that a deceleration rate of the moving speed is smaller as a thickness of the sheet bundle is larger.

In a fourth aspect of the present invention, there is provided a method of controlling a sheet post-processing apparatus including a holding member configured to be used for holding a sheet bundle, a moving unit configured to move the holding member between a predetermined reference position and a predetermined holding position at which the holding member holds the sheet bundle, and a sheet post-processing unit configured to perform post-processing on the sheet bundle held by the holding member, the method comprising moving the holding member from the predetermined reference position using the moving unit, and making timing of stopping the moving unit so as to position the holding member at the holding position later as a thickness of the sheet bundle is larger.

According to the present invention, it is possible to perform post-processing of sheets by stably stopping the clamping member at the predetermined target position (holding position) irrespective of the thickness of the bundle of the sheets.

Further features of the present invention will become apparent from the following description of exemplary embodiments with reference to the attached drawings.

BRIEF DESCRIPTION OF THE DRAWINGS

FIG. 4A, 4B are schematic diagrams of a clamp unit appearing in FIG. 2 as viewed from the direction of an arrow F in FIG. 2, in which FIG. 4A shows a state in which the clamp unit does not hold a sheet bundle, and FIG. 4B shows a state in which the clamp unit is holding the sheet bundle.

FIGS. 7A to 7C are timing diagrams illustrating speed control and stop control of the clamp motor, which are described with reference to FIG. 6, in which FIG. 7A is a timing diagram of the clamp motor when holding a sheet bundle in a case where the number of sheets of the sheet bundle is smaller than a predetermined number, FIG. 7B is a timing diagram of the clamp motor when holding a sheet bundle in a case where the number of sheets of the sheet bundle is not smaller than the predetermined number, and FIG. 7C is a timing diagram of the clamp motor when releasing a state of holding the sheet bundle.

DESCRIPTION OF THE EMBODIMENTS

The present invention will now be described in detail below with reference to the accompanying drawings showing embodiments thereof.

Figure 1:
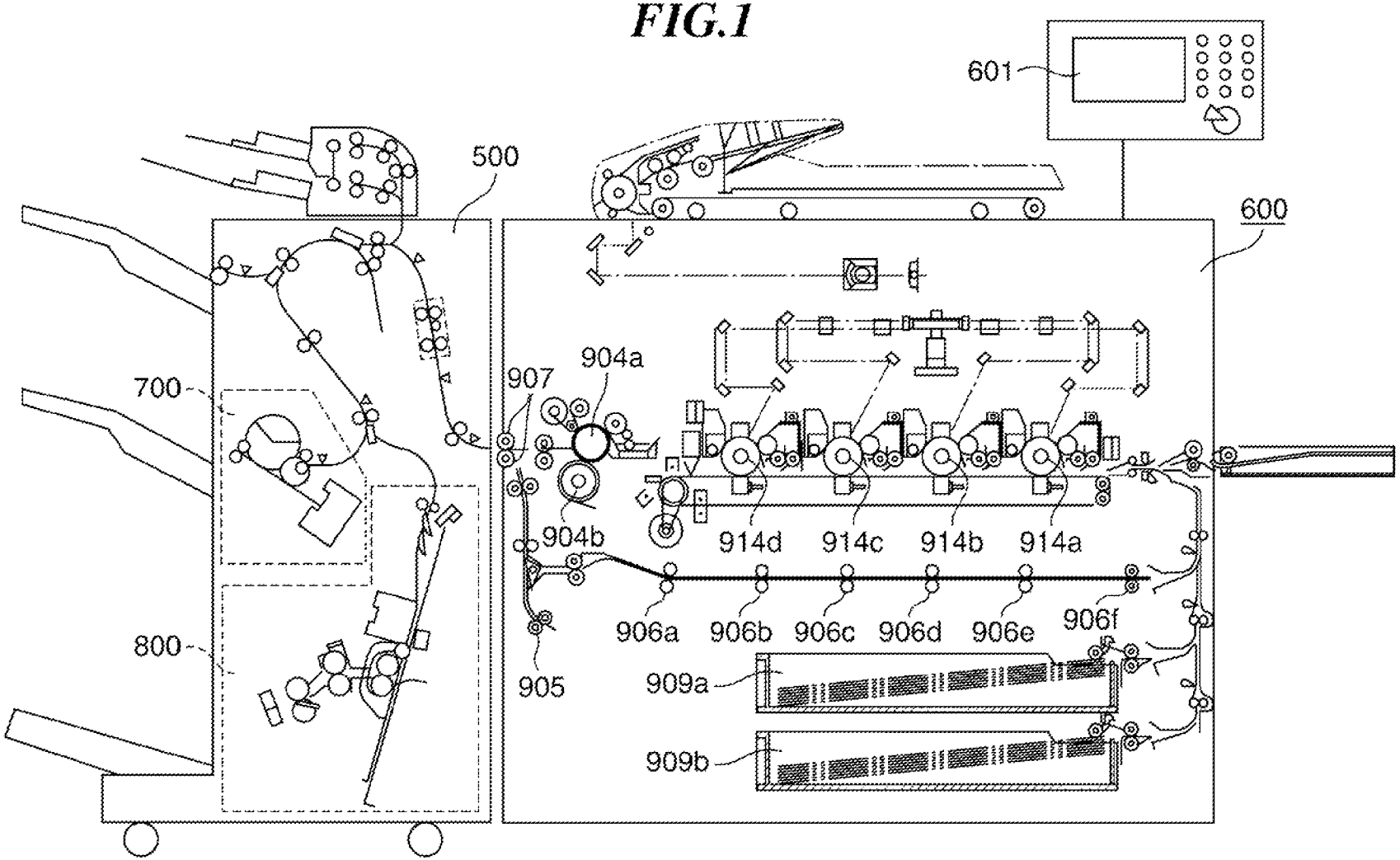
FIG. 1 is a schematic longitudinal cross-sectional diagram of an image forming apparatus including a sheet post-processing apparatus according to a first embodiment of the present invention.

FIG. 1 is a schematic longitudinal cross-sectional diagram of an image forming apparatus including a sheet post-processing apparatus according to a first embodiment of the present invention.

The image forming apparatus shown in FIG. 1 includes an image forming apparatus main body 600 and a saddle stitch bookbinding apparatus 500 as the sheet post-processing apparatus according to the present embodiment. The image forming apparatus main body 600 performs monochrome or color image formation. Further, the saddle stitch bookbinding apparatus 500 is connected to the image forming apparatus main body 600.

After being subjected to image formation by the image forming apparatus main body 600, sheets are sent to the saddle stitch bookbinding apparatus 500, where they are subjected to saddle stitch binding processing. Note that in a case where the saddle stitch bookbinding apparatus 500 is not connected to the image forming apparatus main body 600, the sheets each having an image formed thereon are discharged out of the machine via a discharge outlet. Further, the saddle stitch bookbinding apparatus 500 may be integrally incorporated in the image forming apparatus main body 600 as a sheet discharge device.

The image forming apparatus main body 600 includes a console section 601 for executing various inputs or settings. Here, a side from which a user faces a screen displayed on the console section 601 is called the near side, and a rear side of the apparatus opposite thereto is called the far side.

The image forming apparatus main body 600 comprises a image formation section which includes a yellow (Y) photosensitive drum 914*a*, a magenta (M) photosensitive drum 914*b*, a cyan (C) photosensitive drum 914*c*, and a black (K) photosensitive drum 914*d*.

Onto a sheet (recording paper) fed from a cassette 909*a* or 909*b*, the four color toner images of a Y toner image, an M toner image, a C toner image, and a K toner image are sequentially transferred from the yellow (Y) photosensitive drum 914*a*, the magenta (M) photosensitive drum 914*b*, the cyan (C) photosensitive drum 914*c*, and the black (K) photosensitive drum 914*d*, respectively. Thus, a color toner image is formed on the sheet.

The sheet on which the color toner image is formed is conveyed to a fixing device, and the color toner image is fixed to the sheet by a pressure roller 904*a* and a fixing roller 904*b*.

In the case of a single-sided image formation mode (single-sided print mode), after being subjected to fixing, each sheet is discharged out of the image forming apparatus main body 600 by a discharge roller pair 907.

On the other hand, in the case of a double-sided image formation mode (double-sided print mode), after being subjected to fixing, the sheet is conveyed to an inversion roller 905. When a trailing end of the sheet in the conveying direction goes beyond an inversion flapper (not shown), the inversion roller 905 performs reverse rotation. This causes the sheet to be conveyed along a conveying path by double-sided conveying rollers 906*a* to 906*f*, and be conveyed to the image formation section again. Then, a color toner image is formed on the reverse side of the sheet.

After that, the sheet is conveyed to the fixing device, where fixing of the color toner image is executed, and then the sheet is discharged out of the image forming apparatus main body 600 by the discharge roller pair 907.

Figure 2:
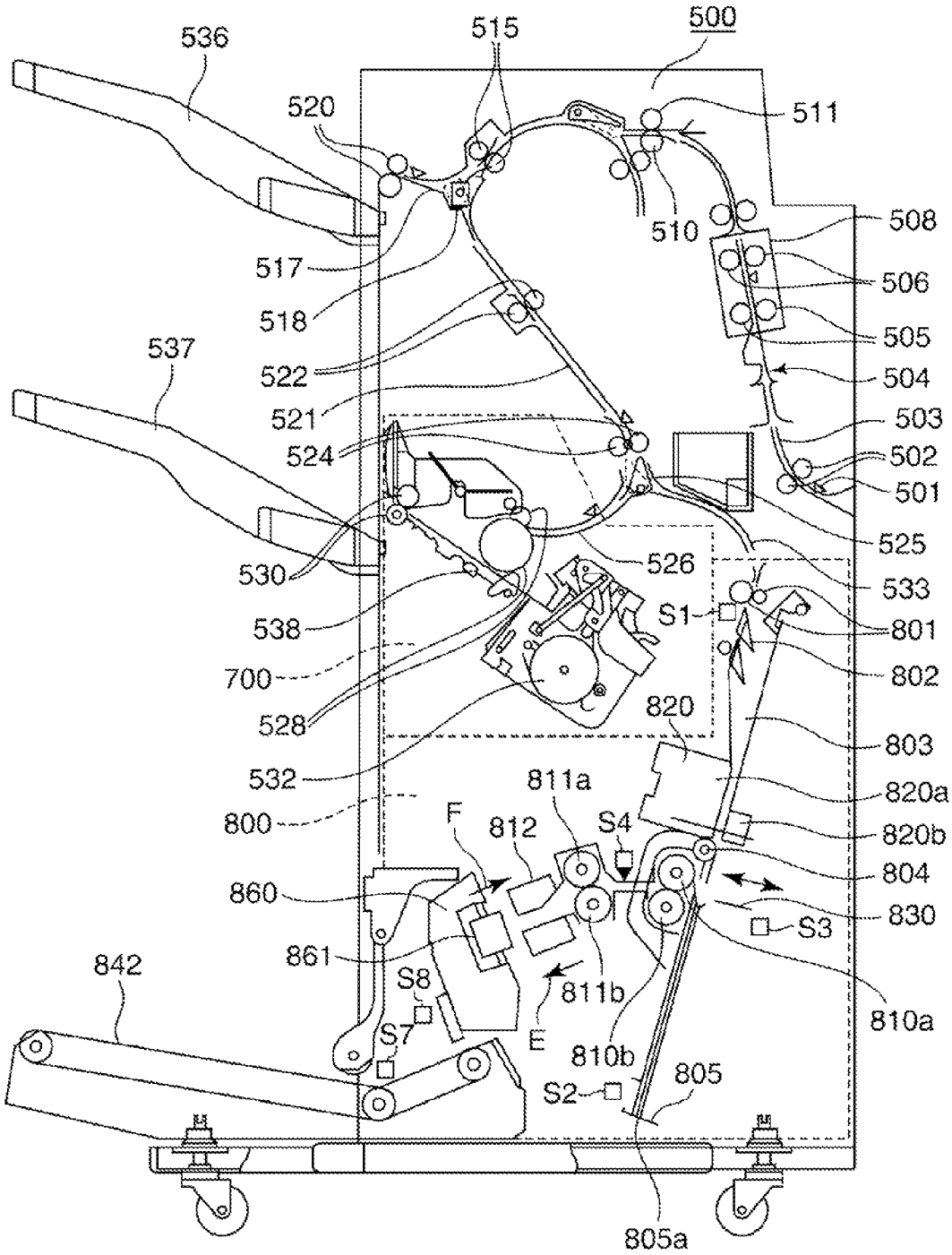
FIG. 2 is a diagram showing details of the sheet post-processing apparatus (saddle stitch bookbinding apparatus) appeared in FIG. 1.

FIG. 2 is a diagram showing details of the saddle stitch bookbinding apparatus 500 appearing in FIG. 1

Referring to FIG. 1 and FIG. 2, the saddle stitch bookbinding apparatus 500 includes a side stitch bookbinding section 700 and a saddle stitch bookbinding section 800. When performing the post-processing (e.g. bookbinding), a sheet S is sent from the image forming apparatus main body 600 to the saddle stitch bookbinding apparatus 500.

In the saddle stitch bookbinding apparatus 500, the sheet S is passed to an inlet roller pair 502. At this time, passing timing of the sheet S is detected by an inlet sensor 501. When the sheet S is conveyed through a conveying passage 503, end positions of the sheet in a lateral direction orthogonal to the conveying direction of the sheet are detected by end detection sensor unit 504. The end detection sensor unit 504 detects a lateral positional error of the sheet with respect to the conveying central position in the lateral direction, which is caused during conveying of the sheet.

After the lateral positional error is detected, the sheet S is sent to a shift unit 508. The shift unit 508 includes a shift roller pair 505 and a shift roller pair 506. During conveying of the sheet by the shift roller pairs 505 and 506, the shift unit 508 is moved toward the near side or the far side opposite thereto in the lateral direction according to the detection results of the end detection sensor unit 504, whereby the sheet is shifted in the lateral direction. Here, to be more specific in association with the saddle stitch bookbinding apparatus 500, the near side is intended to mean a side of the sheet positioned in the saddle stitch bookbinding apparatus 500 appearing in FIG. 2, which corresponds to a side of the FIG. 2 drawing sheet toward the viewer.

Then, the sheet S is conveyed by a conveying roller 510 and a separation roller 511, and reaches a buffer roller pair 515. In a case where the sheet S is discharged onto an upper discharge tray 536, an upper path switching member 518 is driven by a drive section (not shown), such as a solenoid, whereby the sheet S is guided to an upper path conveying passage 517. Then, the sheet S is discharged onto the upper discharge tray 536 by an upper discharge roller pair 520.

In a case where the sheet S is not discharged onto the upper discharge tray 536, the sheet S is guided to a bundle conveying passage 521 by the upper path switching member 518. Then, the sheet S is conveyed by a buffer roller pair 522 and a bundle conveying roller pair 524.

In a case where the sheet S is subjected to saddle processing (saddle stitching), a saddle path-switching member 525 is moved by a drive section (not shown), such as a solenoid. This causes the sheet S to be conveyed to a saddle path conveying passage 533. The sheet S is guided to the saddle stitch bookbinding section 800 by a saddle inlet roller pair 801, and the saddle stitch bookbinding processing (saddle processing) is executed.

In a case where the sheet S is discharged onto a lower discharge tray 537, the sheet S is conveyed to a lower path conveying passage 526 by the saddle path-switching member 525. Then, the sheet S is discharged onto an intermediate process tray 538 by a lower discharge roller pair 528. A plurality of the sheets S are stacked on this intermediate process tray 538, and stitching (stapling) is performed on the sheet bundle by a stapler 532 in the intermediate process tray 538. Then, the sheet bundle is discharged onto the lower discharge tray 537 by a discharge roller pair 530.

Next, the saddle stitch bookbinding section 800 appearing in FIGS. 1 and 2 will be described in detail.

When the sheet S is conveyed to the saddle stitch bookbinding section 800, first, it is passed to a saddle inlet roller pair 801. Then, a conveying inlet of the sheet S is selected according to the size of the sheet S by a switching member 802 driven by a solenoid, and the sheet S is conveyed to a storage guide 803. The storage guide 803 is inclined such that the downstream side of the sheet S in the conveying direction is lower than the upstream side of the same. After being conveyed into the storage guide 803, the sheet S is conveyed by a slide roller 804 of which the roller surface has a sliding property.

The saddle inlet roller pair 801 and the slide roller 804 are driven by a saddle stitch inlet roller motor M1 (not shown in FIG. 2; see FIG. 5), and are controlled according to a result of detection by a saddle stitch inlet sensor S1. The sheet S is conveyed until an end (downstream end in the conveying direction) thereof abuts against an end stopper 805 which has been moved to a predetermined position in advance according to the sheet size (length of the sheet in the conveying direction).

The end stopper 805 is controlled according to a result of detection by an end stopper shift sensor S2, and is capable of moving along a sheet guide surface of the storage guide 803 in the conveying direction of the sheet. The end stopper 805 is moved in the conveying direction of the sheet by being driving by an end stopper moving motor M2 (not shown in FIG. 2; see FIG. 5).

This end stopper 805 includes a restriction surface 805*a* which protrudes from the storage guide 803, and receives the downstream end of the sheet S in the conveying direction which is conveyed into the storage guide 803, with the restriction surface 805*a*, to thereby hold the sheet S thereat. As described above, sheets S are stacked on the storage guide 803 to form a sheet bundle.

At an intermediate location of the storage guide 803, a stapler 820 is disposed. The stapler 820 functions as a stapling section which staples a central portion of the sheet bundle in the conveying direction which is stacked in the storage guide 803. The stapler 820 includes a driver 820*a* and an anvil 820*b*, and the driver 820*a* and the anvil 820*b* are disposed in a manner opposed to each other across the storage guide 803. The driver 820*a* thrusts a staple through the sheet bundle, and the anvil 820*b* bends a portion of the staple thrust out of the sheet bundle.

On the downstream side of the stapler 820, a folding roller pair 810*a* and 810*b*, and a thrusting member 830 are disposed in an opposed relation. The folding roller pair 810*a* and 810*b* and the thrusting member 830 are used when folding the sheet bundle stacked in the storage guide 803 into two at the central portion thereof in the conveying direction.

In FIG. 2, the thrusting member 830 is illustrated in a home position (HP) which is a position retreated from the storage guide 803. When center folding is executed, the thrusting member 830 trusts the central portion, in the conveying direction, of the sheet bundle stored in the storage guide 803, by driving of a thrust motor M3 (not shown in FIG. 2; see FIG. 5). The thrusting member 830 thus performs a center folding operation to fold the sheet bundle into two at the central portion, by pushing the sheet bundle into a nip of the folding roller pair 810*a* and 810*b*. Note that the home position is detected by a thrust sensor S3, and the amount of thrust is detected by a thrust encoder sensor S5 (see FIG. 5) that detects an amount of rotation of the thrust motor M3.

The sheet bundle with a fold line is conveyed by a folding conveyance roller pair 811*a* and 811*b*, and a leading end portion of the folded sheet bundle is conveyed up to a flattening unit 860. When the front end portion is conveyed to the flattening unit 860, the folded sheet bundle is stopped. Then, the sheet bundle is held by a clamp unit 812. Note that the construction of the clamp unit 812 will be described hereinafter.

The flattening unit 860 moves a flattening roller 861 along a folded portion of the sheet bundle held by the clamp unit 812, which forms a spine of a booklet, while applying pressure to the folded portion with the flattening roller 861. Thus, the flattening unit 860 performs flattening of the folded portion including the fold line. The term "flattening" is intended to mean processing for flattening a folded portion including a fold line at which a sheet bundle is folded back, into a wide flat portion. After being subjected to flattening by the flattening unit 860, The booklet is conveyed downstream, and is discharged onto a folded bundle discharge tray 842.

Figure 5:
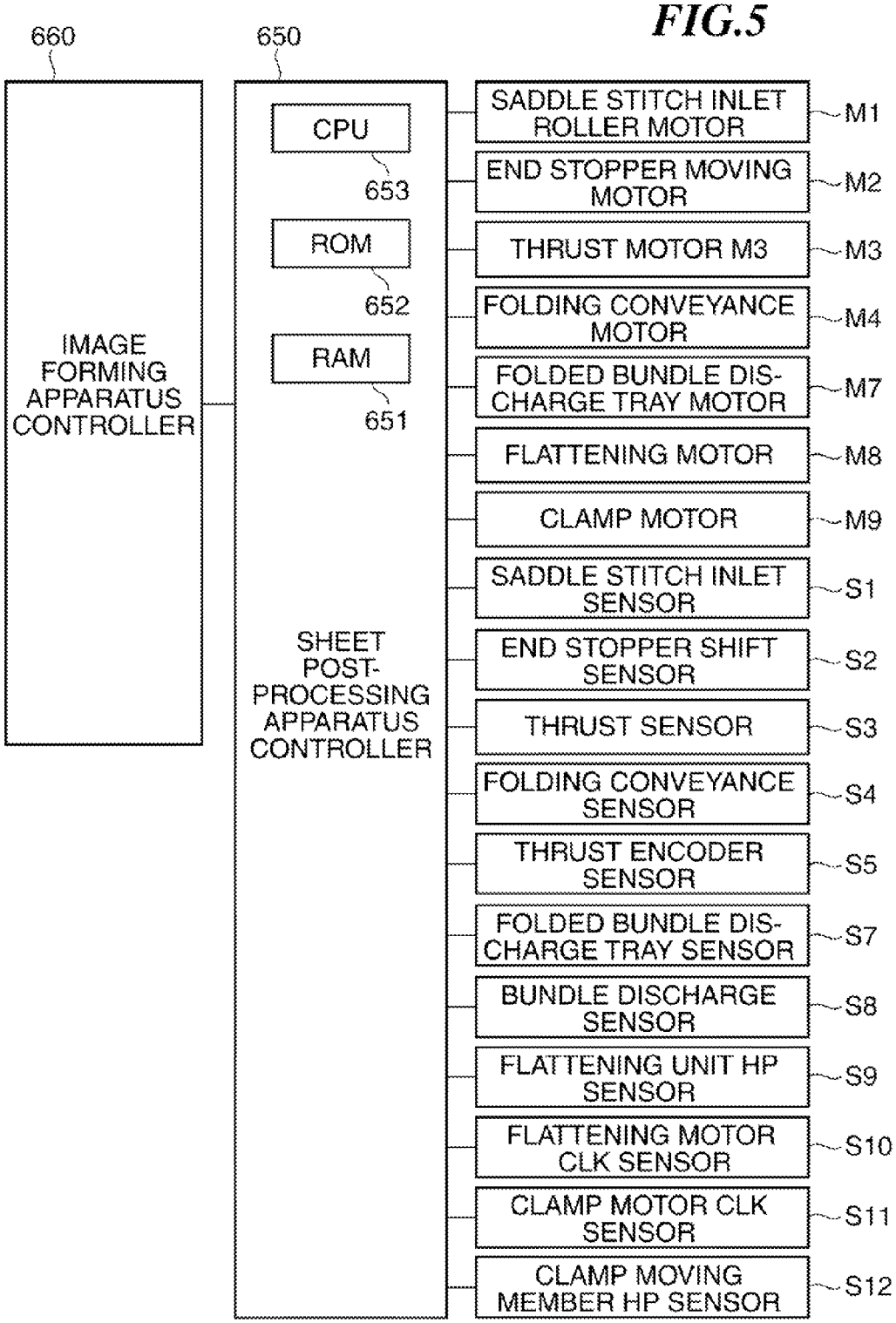
FIG. 5 is a block diagram of a control system of the image forming apparatus shown in FIG. 1.

In the folded bundle discharge tray 842, a conveyer on the surface of the tray is rotated and moved by a folded bundle discharge tray motor M7 (not shown in FIG. 2; see FIG. 5). Discharged sheet bundles are moved downstream until a folded bundle discharge tray sensor S7 for detecting the sheet bundles discharged one upon another turns off. Thus, sheet bundles are stacked on the folded bundle discharge tray 842.

Note that the folding roller pair 810*a* and 810*b* and the folding conveyance roller pair 811*a* and 811*b* are driven by a folding conveyance motor M4 (not shown in FIG. 2; see FIG. 5). A folding conveyance sensor S4 detects the rotational speed of the folding conveyance motor M4, and an electric current applied to the folding conveyance motor M4 is controlled according to a result of detection by the folding conveyance sensor S4. For example, the folding conveyance sensor S4 is implemented by an optical encoder mounted on a rotating shaft of the folding conveyance motor M4, and the number of rotations and the rotational speed of the folding conveyance motor M4 are detected by pulses output from the encoder.

Further, a stop position of the booklet before executing flattening, i.e. stop timing of the booklet, is controlled by counting the number of pulses output from the folding conveyance sensor S4.

Figure 3:
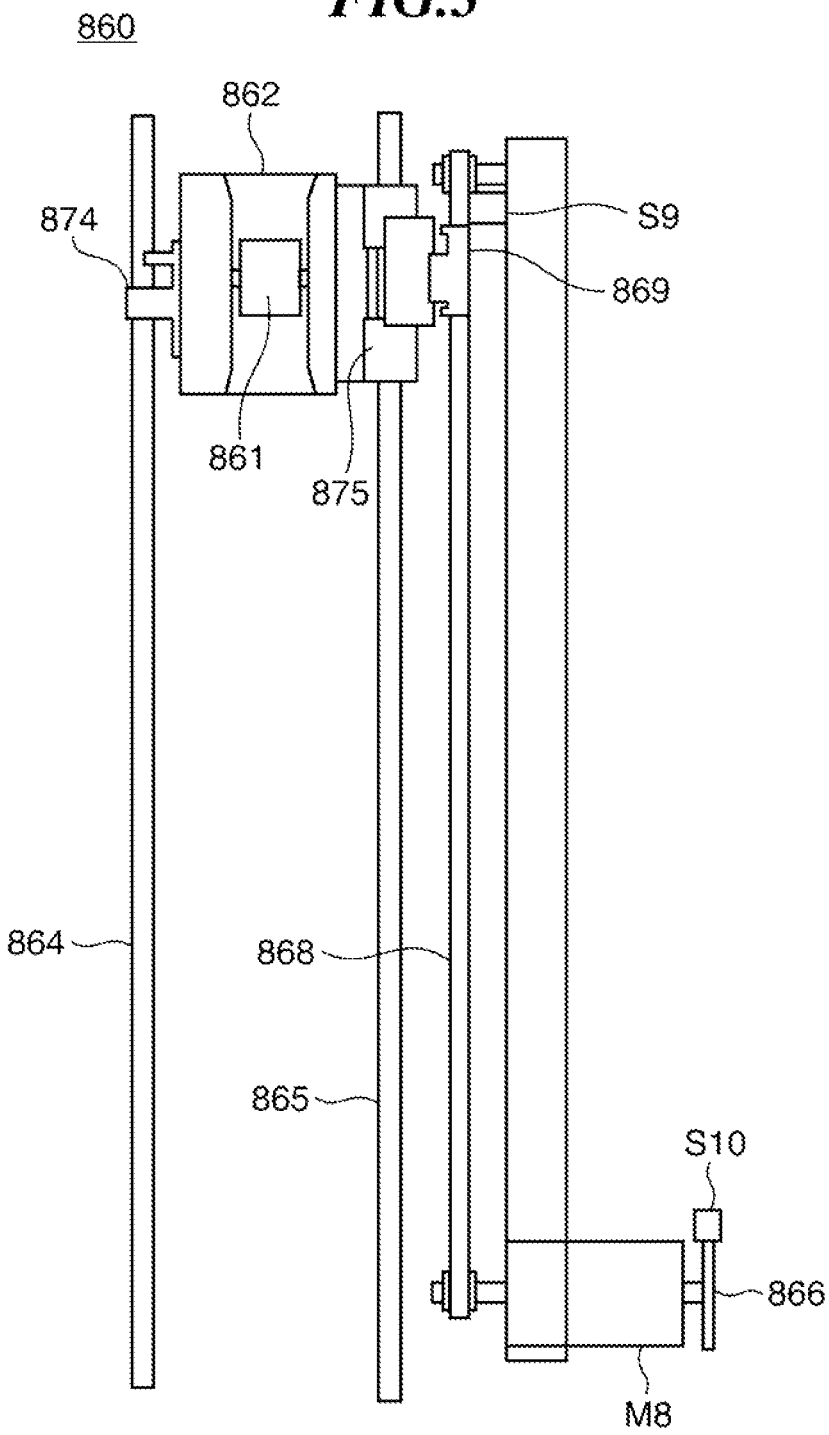
FIG. 3 is a schematic diagram of a flattening unit appearing in FIG. 2 as viewed from the direction of an arrow E in FIG. 2.

FIG. 3 is a schematic diagram of the flattening unit 860 appearing in FIG. 2, as viewed from the direction of an arrow E in FIG. 2.

As described above, the flattening unit 860 is disposed on the downstream side of the folding conveyance roller pair 811*a* and 811*b*, and includes the flattening roller 861. The flattening roller 861 is pivotally supported by a holder 862. The holder 862 is supported by slide shafts 864 and 865, via bearings 874 and 875. A timing belt 868 has the holder 862 fixed thereto via a connection metal plate 869, and is rotated by driving of a flattening motor M8. As a result, the holder 862 is caused to move in the sheet lateral direction along the fold line of the sheet bundle according to the rotation of the flattening motor M8.

A flattening unit home position (HP) sensor S9 detects a reference position which is the home position (HP) of the holder 862. On the other hand, a flattening motor clock (CLK) sensor S10 is e.g. an optical sensor, and detects light passing through a slit of a rotary encoder 866 to thereby detect an amount of rotation of the flattening motor M8.

The stop position of the holder 862 is controlled according to the amount of rotation of the flattening motor M8 detected by the flattening motor clock sensor S10, with reference to the detecting position of the flattening unit HP sensor S9 as the reference position.

Figure 4A:
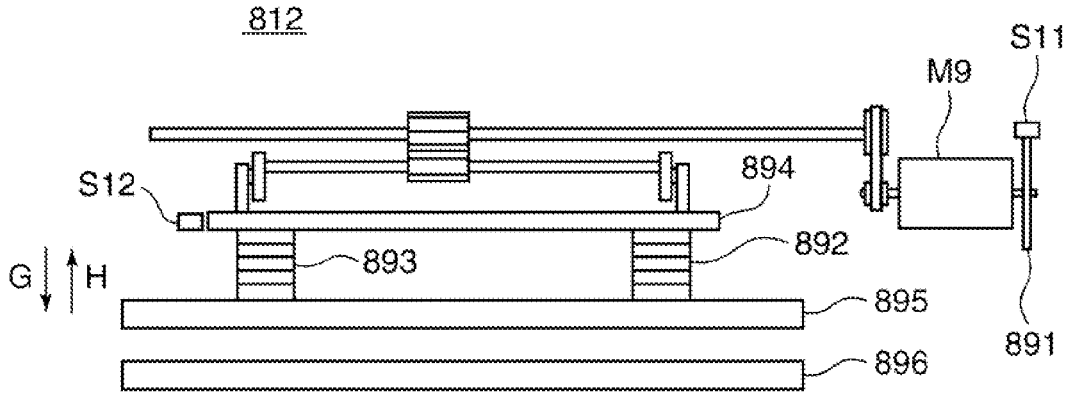
Figure 4B:
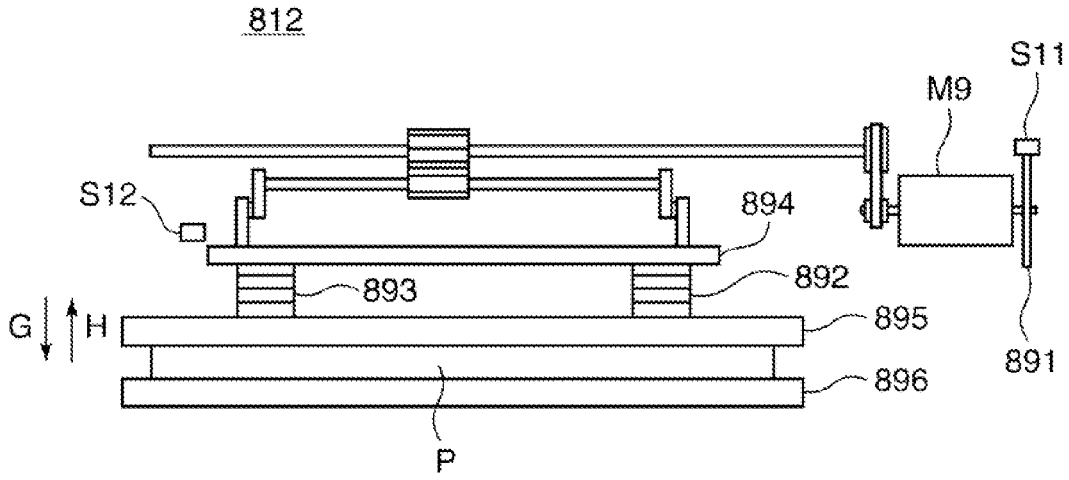

FIGS. 4A and 4B are schematic diagrams of the clamp unit 812 appearing in FIG. 2, as viewed from the direction of an arrow F in FIG. 2. FIG. 4A shows a state in which the clamp unit 812 does not hold a sheet bundle, and FIG. 4B shows a state in which the clamp unit 812 is holding the sheet bundle.

Referring to FIG. 4A, the clamp unit 812 includes a clamp moving member 894, and the clamp moving member 894 is moved in directions of G and H by a link mechanism according to driving of a clamp motor M9. A holding member 895 is connected to the clamp moving member 894 via pressure springs 892 and 893 (biasing members). The holding member 895 is moved in a manner interlocked with the movement of the clamp moving member 894. Note that the direction of G is a direction in which the clamp moving member 894 is moved toward the holding member 895 and the direction of H is a direction in which the clamp moving member 894 is moved away from the holding member 895. A sheet bundle is sandwiched between the holding member 895 and a holding stay 896 (second holding member), whereby the sheet bundle is held.

Referring to FIG. 4B, where holding the sheet bundle denoted by a symbol P with the clamp unit 812, the clamp moving member 894 is moved in the direction of G. After the holding member 895 reaches the sheet bundle P, the clamp moving member 894 is still moved in the direction of G, whereby the pressure springs 892 and 893 are compressed. This causes the holding member 895 to hold the sheet bundle P with the biasing force of the pressure springs 892 and 893. At this time, the biasing force (pressure) dependent on the amount of compression of the pressure springs 892 and 893 is applied to the sheet bundle.

Therefore, as the sheet bundle P becomes thicker, the amount of compression of the pressure springs 892 and 893 becomes larger, which increase the pressure applied to the sheet bundle P. As a result, load on the clamp motor M9 for moving the clamp moving member 894 in the direction of G increases.

When performing positioning control of the clamp moving member 894, a clamp moving member HP (home position) sensor S12 and a clamp motor clock (CLK) sensor S11 are used. The clamp moving member HP sensor S12 is a sensor for detecting that the clamp moving member 894 is in a retreated position (reference position). Further, the clamp motor clock sensor S11 detects light passing through the slit of a rotary encoder 891 to thereby output a signal synchronized with the rotation of the clamp motor M9. A CPU 653 (see FIG. 5) determines the amount of rotation of the clamp motor M9 by counting the signal (pulses) output from the clamp motor clock sensor S11. The position of the clamp moving member 894 is controlled according to the amount of rotation of the clamp motor M9 detected by the clamp motor clock sensor S11, with reference to the position of the clamp moving member 894 detected by the clamp moving member HP sensor S12 as the reference position.

FIG. 5 is a block diagram of a control system of the image forming apparatus shown in FIG. 1.

Referring to FIG. 5, an image forming apparatus controller 660 is mounted in the image forming apparatus main body 600. A sheet post-processing apparatus controller 650 is mounted e.g. in the sheet post-processing apparatus (saddle stitch bookbinding apparatus) 500 and communicates with the image forming apparatus controller 660 to exchange data therewith.

The sheet post-processing apparatus controller 650 includes the CPU 653, a ROM 652 and a RAM 651. The CPU 653 controls the sheet post-processing apparatus by executing various programs stored in the ROM 652, according to instructions from the image forming apparatus controller 660. The RAM 651 is used as a work area and the like of the CPU 653.

As shown in FIG. 5, connected to the sheet post-processing apparatus controller 650 are the saddle stitch inlet roller motor M1, the end stopper moving motor M2, the thrust motor M3, the folding conveyance motor M4, the folded bundle discharge tray motor M7, the flattening motor M8, the clamp motor M9, the saddle stitch inlet sensor S1, the end stopper shift sensor S2, the thrust sensor S3, the folding conveyance sensor S4, the thrust encoder sensor S5, the folded bundle discharge tray sensor S7, a bundle discharge sensor S8, the flattening unit HP sensor S9, the flattening motor clock sensor S10, the clamp motor clock sensor S11, the clamp moving member HP sensor S12*d*. The CPU 653 performs, as described hereinabove, driving control of each motor based on a result of detection by each sensor.

Figure 6:
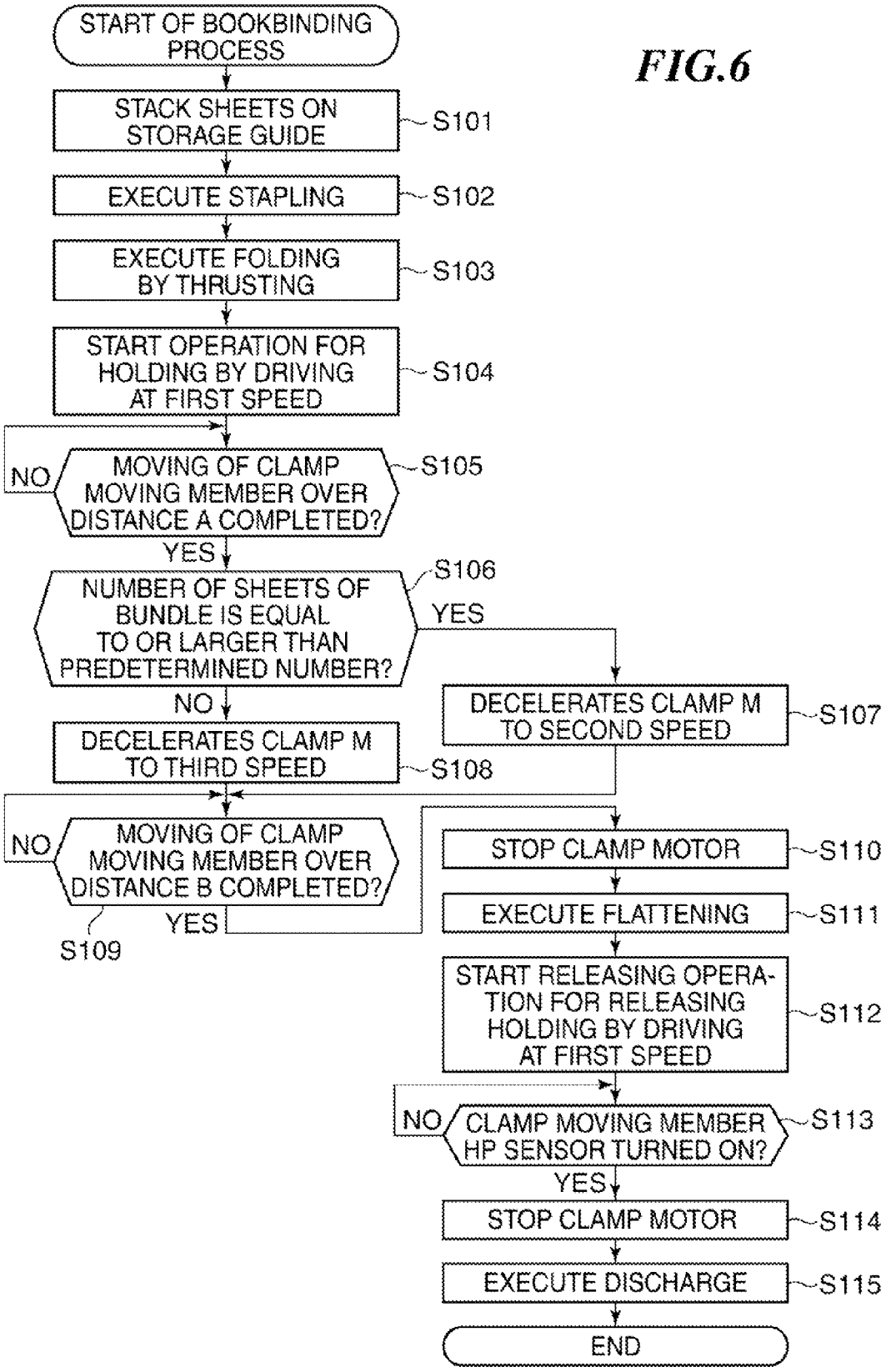
FIG. 6 is a flowchart of a sheet post-processing process performed by a sheet post-processing apparatus controller appearing in FIG. 5.

FIG. 6 is a flowchart of the sheet post-processing process executed by the sheet post-processing apparatus controller 650 appearing in FIG. 5. Note that in the following description, as the sheet post-processing process, a bookbinding process will be described by way of example.

When the bookbinding process is started, the CPU 653 controls relevant sections of the sheet post-processing apparatus, as described above, such that a set number of sheets are stacked as a sheet bundle in the storage guide 803 (S101). Information on the set number of sheets (number of sheets of the sheet bundle) is sent from the image forming apparatus controller 660 to the sheet post-processing apparatus controller 650.

When stacking (placing) of as many sheets as the number of sheets of the sheet bundle is completed, the CPU 653 controls the stapler 820 to perform stapling on the sheet bundle (S102). Next, the CPU 653 performs the above-described center folding, and then thrust folding of the sheet bundle (S103).

Next, the CPU 653 drives the clamp motor M9 at a speed (first speed) in which the pulse frequency output from the clamp motor clock sensor S11 is a predetermined frequency (e.g. 600 Hz). The CPU 653 thus performs shift control for moving the clamp moving member 894 in the direction of G (S104).

Next, the CPU 653 determines whether or not the clamp moving member 894 has moved over a predetermined distance A after the clamp moving member HP sensor S12 turned off (S105). The CPU 653 determines a moving distance of the clamp moving member 894 by counting the number of pulses output from the clamp motor clock sensor S11. Note that the predetermined distance A is determined by taking a brake timing, referred to hereinafter, into account.

If the moving distance of the clamp moving member 894 has not reached the predetermined distance A (No to the step S105), the CPU 653 waits. On the other hand, when the clamp moving member 894 has moved over the predetermined distance A (first distance) (YES to the step S105), the CPU 653 determines whether or not the number of sheets of the sheet bundle is not smaller than a predetermined number (e.g. 16) (step S106).

If the number of sheets of the sheet bundle is not smaller than the predetermined number (e.g. equal to 16 or larger) (YES to the step S106), the CPU 653 decelerates the rotational speed of the clamp motor M9 to a second speed at which the pulse frequency output from the clamp motor clock sensor S11 becomes a first frequency (e.g. 400 Hz) (S107). As a result, the moving speed of the clamp moving member 894 is decelerated.

If the number of sheets of the sheet bundle is smaller than the predetermined number of sheets (equal to 15 or smaller) (NO to the step S106), the CPU 653 decelerates the rotational speed of the clamp motor M9 to a third speed at which the pulse frequency output from the clamp motor clock sensor S11 becomes a second frequency (second frequency<first frequency; e.g. 300 Hz) (S108). In the present example, it is assumed that the first speed>second speed>third speed.

After the processing in the step S107 or S108 is executed, the CPU 653 determines whether or not the clamp moving member 894 has moved over a predetermined distance B after the clamp moving member HP sensor S12 turned off (S109). In the present embodiment, it is assumed that the distance B>the distance A.

If the moving distance of the clamp moving member 894 has not reached the predetermined distance B (moving distance) (NO to the step S109), the CPU 653 waits. On the other hand, if the clamp moving member 894 has moved over the predetermined distance B (YES to the step S109), the CPU 653 executes stopping control processing for stopping the clamp motor M9 to thereby stop the clamp moving member 894 (S110).

The brake is thus applied to the clamp motor M9 after decelerating the speed of the clamp moving member 894 to a speed dependent on the number of sheets of the sheet bundle. This makes it possible to stabilize the braking distance over which the clamp moving member 894 moves before it is stopped after starting braking.

Note that in the above-described example, although the speed of the clamp moving member 894 is decelerated to a speed dependent on the number of sheets of the sheet bundle, this is not limitative, but the speed of the clamp moving member 894 may be configured to be decelerated to a speed dependent on the basis weight of each sheet and the number of sheets of a sheet bundle. Further, the speed of the clamp moving member 894 may be configured to be decelerated to a speed dependent on the thickness of a sheet bundle by detecting the thickness of the sheet bundle.

As described above, after stopping the clamp moving member 894 and holding the sheet bundle using the holding member 895 and the holding stay 896, the CPU 653 controls the flattening unit 860 (sheet post-processing unit) such that the flattening roller 861 is moved along the fold line of the sheet bundle (booklet) while applying pressure to the folded portion, which is to form a spine, of the booklet with the flattening roller 861. Thus, the CPU 653 causes the flattening of the folded portion including the fold line to be executed on the booklet (S111).

After the flattening of the folded portion including the fold line is completed, the CPU 653 drives the clamp motor M9 in a reverse direction at the first speed in which the pulse frequency output from the clamp motor clock sensor S11 is the predetermined frequency (e.g. 600 Hz) to thereby release the state of holding the booklet by the clamp unit 812 (S112). Thus, the CPU 653 moves the clamp moving member 894 in the direction (direction of H) away from the holding member 895.

Next, the CPU 653 determines whether or not the clamp moving member HP sensor S12 has turned on (S113). If the clamp moving member HP sensor S12 has not turned on (NO to the step S113), the CPU 653 waits until the clamp moving member HP sensor S12 turns on. On the other hand, if the clamp moving member HP sensor S12 has turned on (YES to the step S113), the CPU 653 stops the clamp motor M9 to thereby stop the movement of the clamp moving member 894 in the direction of H (S114). Then, the CPU 653 performs discharge of the processed sheet bundle (S115), followed by terminating the bookbinding process.

Although in the example shown in FIG. 6, when changing the rotational speed of the clamp motor M9, the rotational speed of the clamp motor is controlled such that the pulse frequency output from the clamp motor clock sensor S11 becomes one of 600 Hz, 400 Hz or 300 Hz, this is not limitative, but the speed may be changed to any suitable speed insofar as it is a speed from which the clamp moving member 894 can be stably stopped.

Figure 7A:
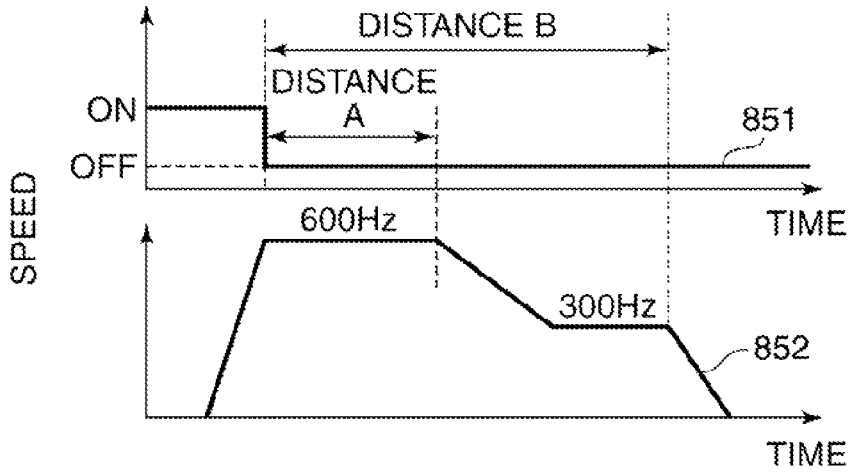
Figure 7B:
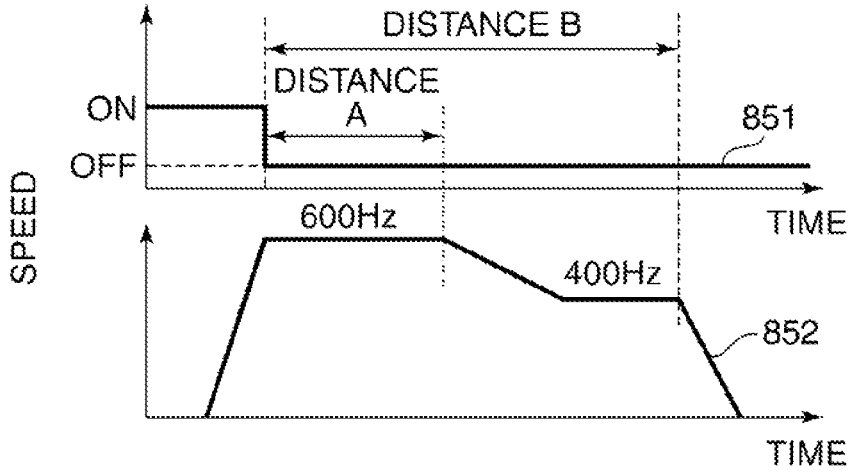
Figure 7C:
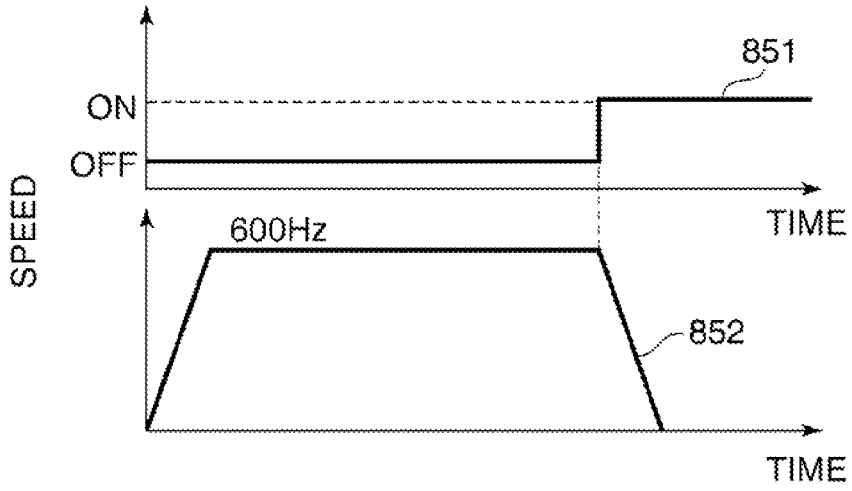

FIGS. 7A to 7C are timing diagrams illustrating speed control and stop control of the clamp motor M9, described above with reference to FIG. 6. FIG. 7A is a timing diagram of the clamp motor M9 when holding a sheet bundle in a case where the number of sheets of the sheet bundle is smaller than a predetermined number. FIG. 7B is a timing diagram of the clamp motor M9 when holding a sheet bundle in a case where the number of sheets of the sheet bundle is not smaller than the predetermined number. FIG. 7C is a timing diagram of the clamp motor M9 when releasing a state of holding the sheet bundle. Note that in FIGS. 7A to 7C, reference numeral 851 denotes an output from the clamp moving member HP sensor S12, and reference numeral 852 denotes the frequency of the output pulse from the clamp motor clock sensor S11, i.e. the rotational speed of the clamp motor M9.

Referring to FIG. 7A, first, the CPU 653 starts the clamp motor M6. The speed of the clamp motor M6 is controlled such that when the clamp moving member HP sensor S12 turns off, it is set to the first speed. In the first speed, the frequency of the output pulse from the clamp motor clock sensor S11 is controlled to be e.g. 600 Hz.

In the case of the example illustrated in FIG. 7A, it is assumed that the number of sheets of the sheet bundle is smaller than the predetermined number (e.g. 15 or smaller), and hence when the clamp moving member 894 has moved over the predetermined distance A, the CPU 653 decelerates the clamp motor M9 by setting the speed of the clamp motor M6 to the third speed. In the third speed, the frequency of the output pulse from the clamp motor clock sensor S11 is controlled to be e.g. 300 Hz.

Next, when the clamp moving member 894 has moved over the predetermined distance B after the clamp moving member HP sensor S12 turned off, the CPU 653 executes the stop control of the clamp motor M9. During this control, the clamp moving member 894 slightly moves before the clamp motor M9 is stopped.

Referring to FIG. 7B, first, the CPU 653 starts the clamp motor M6. The speed of the clamp motor M6 is controlled such that when the clamp moving member HP sensor S12 turns off, it is set to the first speed. In the case of the example illustrated in FIG. 7B, it is assumed that the number of sheets of a sheet bundle is not smaller than the predetermined number (e.g. 16 or more), and hence when the clamp moving member 894 has moved over the predetermined distance A, the CPU 653 decelerates the clamp motor M9 by setting the speed of the clamp motor M6 to the second speed. In the second speed, the frequency of the output pulse of the clamp motor clock sensor S11 is controlled to be e.g. 400 Hz.

Next, when the clamp moving member 894 has moved over the predetermined distance B after the clamp moving member HP sensor S12 turned off, the CPU executes the stop control of the clamp motor M9. During this control, the clamp moving member 894 slightly moves before the clamp motor M9 is stopped.

Referring to FIG. 7C, when releasing the state of holding the sheet bundle, the CPU 653 starts the clamp motor M6 to drive the same in a reverse direction. The CPU 653 moves the clamp moving member 894 in the direction of H by setting the speed of the clamp motor M6 to the first speed. When the clamp moving member HP sensor S12 has turned on, the CPU 653 executes the stop control of the clamp motor M9. During this control, the clamp moving member 894 slightly moves before the clamp motor M9 is stopped.

When the clamp moving member 894 is moved in the direction of H, i.e. when releasing the state of holding the sheet bundle, the load is fixed irrespective of the number of sheets of the sheet bundle, and hence the stop position of the clamp moving member 894 is stable even if the clamp motor M9 is not decelerated before stopping the same.

As described above, in the first embodiment, if the number of sheets of the sheet bundle is not smaller than the predetermined number, the clamp motor M9 is decelerated to the second speed before starting braking, whereas if the number of sheets of the sheet bundle is smaller than the predetermined number, the clamp motor M9 is decelerated to the third speed which is slower than the second speed before starting braking. Therefore, the braking distance of the clamp motor M9 can be stabilized irrespective of the number of sheets of the sheet bundle, and the clamp moving member 894 can be stably stopped at the predetermined target position (holding position).

In addition, since the clamp moving member 894 can be stopped at the target position irrespective of the number and type of sheets of a sheet bundle, the clamp moving member 894 does not reach a limit position of movement thereof beyond the target position, and hence it is possible not only to prevent failure of the clamp unit 812 but also to achieve a desired holding force. As a result, it is possible to attain sufficient flattening of the sheet bundle.

Next, a sheet post-processing apparatus according to a second embodiment of the present invention will be described. Note that the arrangement of the sheet post-processing apparatus according to the second embodiment is same as that of the sheet post-processing apparatus shown in FIGS. 1 to 5, and hence components are denoted by same reference numerals while omitting the description thereof.

Figure 8:
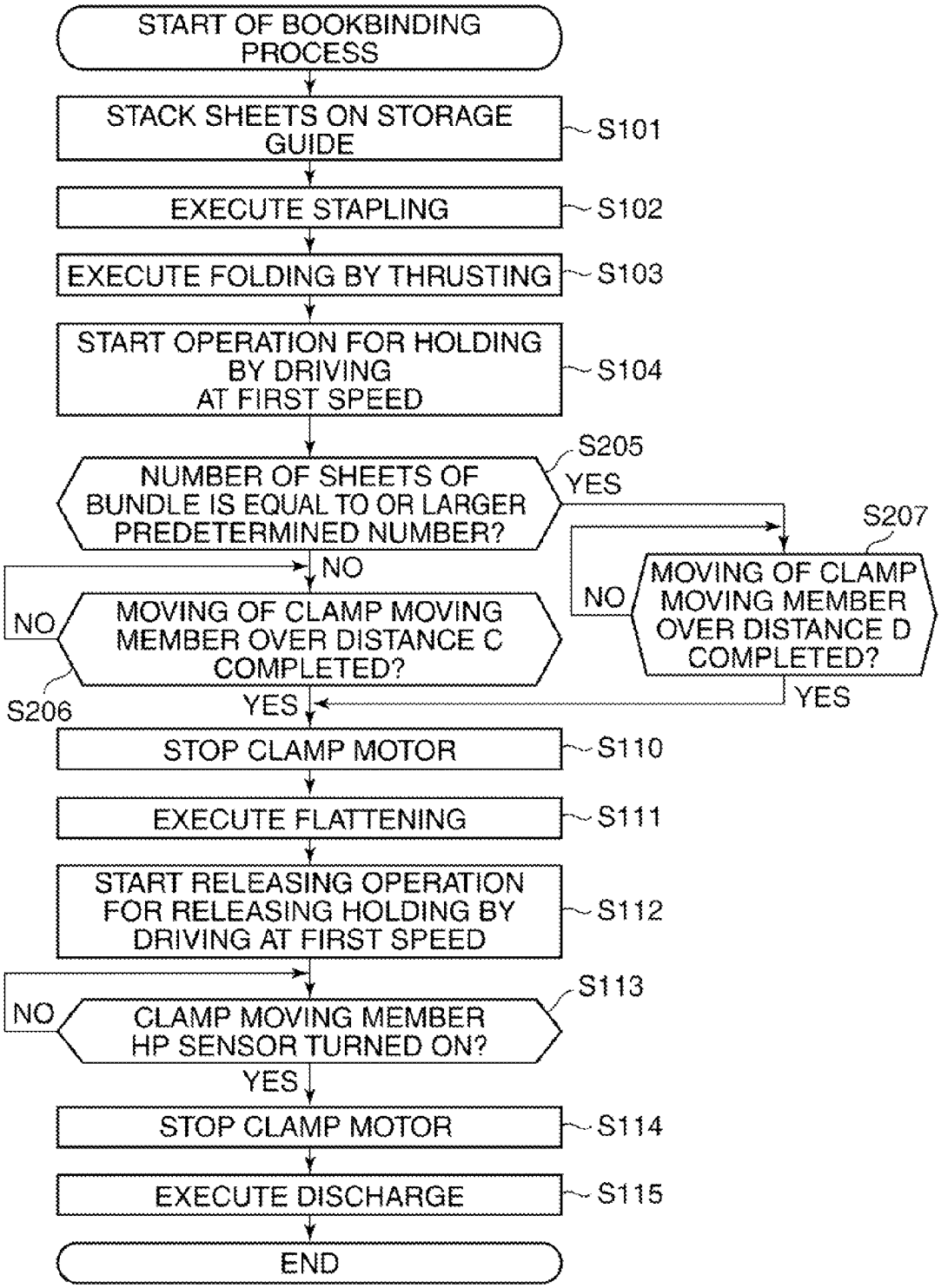
FIG. 8 is a flowchart of a sheet post-processing process executed by a sheet post-processing apparatus according to a second embodiment of the present invention.

FIG. 8 is a flowchart of a bookbinding process as a sheet post-processing process executed by the sheet post-processing apparatus according to the second embodiment. Note that the same steps in FIG. 8 as those in FIG. 6 are denoted by the same step numbers, and detailed description thereof is omitted.

When the bookbinding process is started, the CPU 653 executes the above-mentioned steps S101 to S104. After the step S104 is executed, the CPU 653 determines whether or not the number of sheets of the sheet bundle is not smaller than the predetermined number (e.g. equal to 16 or larger) (S205). If the number of sheets of the sheet bundle is smaller than the predetermined number (e.g. equal to 15 or smaller) (NO to the step S205), the CPU 653 determines whether or not the clamp moving member 894 has moved over the predetermined distance C (first distance) after the clamp moving member HP sensor S12 turned off (S206).

If the moving distance of the clamp moving member 894 has not reached the predetermined distance C (NO to the step S206), the CPU 653 waits, whereas if the clamp moving member 894 has moved over the predetermined distance C (YES to the step S206), the CPU 653 executes the step S110 described hereinabove.

If the number of sheets of the sheet bundle is not smaller than the predetermined number (equal to 16 or larger) (YES to the step S205), the CPU 653 determines whether or not the clamp moving member 894 has moved over a predetermined distance D (second distance) after the clamp moving member HP sensor S12 turned off (S207). If the moving distance of the clamp moving member 894 has not reached the predetermined distance D (NO to the step S207), the CPU 653 waits, whereas if the clamp moving member 894 has moved over the predetermined distance D (YES to the step S207), the CPU 653 executes the step S110 described hereinabove.

Then, the CPU 653 executes the steps S111 to S115 described hereinabove, followed by terminating the bookbinding process.

As the number of sheets of a sheet bundle is smaller, the load applied to the clamp motor M9 becomes smaller, and accordingly the braking distance becomes longer over which the clamp unit 812 moves before the clamp motor M9 is stopped after starting braking. Therefore, the distance C and the distance D are set such that distance C>distance D.

As described above, in the second embodiment, brake timing (i.e. stop control timing) of the clamp motor M9 is configured to be changed according to the number of sheets of a sheet bundle. Therefore, the clamp moving member can be stably stopped at the target position even when the braking distance varies with the number of sheets of the sheet bundle.

Further, the clamp moving member can be stopped at the target position irrespective of the number and type of sheets of a sheet bundle. Therefore, the clamp moving member does not reach a limit position of movement, and hence it is possible not only to prevent failure of the apparatus but also to achieve a desired holding force of the clamp unit. As a result, it is possible to perform stable flattening of the folded portion including the fold line of the sheet bundle.

In addition, when moving the clamp moving member in the direction of H, i.e. when releasing the state of holding the sheet bundle, the clamp motor M9 is configured to be driven at the predetermined speed, whereby the time taken to release the state of holding the sheet bundle can be shortened, and productivity is improved accordingly.

Although in the above-described first embodiment, the deceleration rate of the clamp motor M9 is changed before starting braking, according to one threshold number of sheets (predetermined number of sheets), but the deceleration rate of the clamp motor M9 may be changed in a finer-grained manner according to a plurality of threshold numbers of sheets. More specifically, if the threshold number of sheets is N (N is an integer not smaller than 2), there are N deceleration speeds of the clamp motor M9, and the deceleration speed of the clamp motor M9 is selected according to the number of sheets of a sheet bundle, which is classified by the threshold numbers of sheets. In this case as well, as the number of sheets of the sheet bundle is smaller, a target speed to which the rotational speed of the clamp motor M9 is reduced is lower (deceleration rate becomes higher).

As is clear from the above description, in FIG. 5. the CPU 653, the clamp moving member HP sensor S12, and the clamp motor clock sensor S11 function as a control unit and a detecting section.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

This application claims priority from Japanese Patent Application No. 2011-258772 filed Nov. 28, 2011, which is hereby incorporated by reference herein in its entirety.

What is claimed is:

1. A sheet post-processing apparatus comprising:

a holding member configured to be used for holding a sheet bundle;

a moving unit configured to move said holding member between a predetermined reference position and a predetermined holding position at which said holding member holds the sheet bundle;

a sheet post-processing unit configured to perform post-processing on the sheet bundle held by said holding member; and a control unit configured to, after said holding member is moved from the reference position by said moving unit, decelerate a moving speed of said moving unit, before performing a stopping process for stopping said moving unit so as to position said holding member at the holding position, such that a deceleration rate of the moving speed is smaller as a thickness of the sheet bundle is larger.

2. The sheet post-processing apparatus according to claim 1, wherein said moving unit includes a moving member connected to said holding member via a biasing member, and a motor for moving said moving member.

3. The sheet post-processing apparatus according to claim 2, wherein said biasing member comprises springs.

4. The sheet post-processing apparatus according to claim 2, wherein the stopping process is processing for braking said motor.

5. The sheet post-processing apparatus according to claim 1, wherein said holding member holds the sheet bundle by sandwiching the sheet bundle between itself and a second holding member which is fixed.

6. The sheet post-processing apparatus according to claim 1, wherein said post-processing is processing for flattening a folded portion, including a fold line, of the sheet bundle subjected to folding.

7. The sheet post-processing apparatus according to claim 2, further comprising a detecting section configured to detect an amount of movement of said moving member, and wherein said control section decelerates the moving speed of said moving unit when the amount of movement of said moving member reaches a predetermined amount.

8. The sheet post-processing apparatus according to claim 1, wherein said control unit makes a deceleration rate of the moving speed of said moving member lower in a case where the number of sheets of the sheet bundle is not smaller than a predetermined number, than in a case where the number of sheets of the sheet bundle is smaller than the predetermined number.

9. The sheet post-processing apparatus according to claim 1, wherein said control unit decelerates the moving speed of said moving unit from a first speed to a second speed, in a case where the number of sheets of the sheet bundle is not smaller than the predetermined number of sheets, and decelerates the moving speed of said moving unit from the first speed to a third speed which is lower than the second speed, in a case where the number of sheets of the sheet bundle is smaller than the predetermined number.

10. A sheet post-processing apparatus comprising:

a holding member configured to be used for holding a sheet bundle;

a moving unit configured to move said holding member between a predetermined reference position and a predetermined holding position at which said holding member holds the sheet bundle;

a sheet post-processing unit configured to perform post-processing on the sheet bundle held by said holding member; and a control unit configured to, after said holding member is moved from the reference position by said moving unit, make timing of stopping said moving unit so as to position said holding member at the holding position later as a thickness of the sheet bundle is larger.

11. The sheet post-processing apparatus according to claim 10, wherein said moving unit includes a moving member connected to said holding member via an biasing member, and a motor for moving said moving member.

12. The sheet post-processing apparatus according to claim 11, wherein said biasing member comprises springs.

13. The sheet post-processing apparatus according to claim 11, wherein said control unit makes timing of braking said moving unit later as the thickness of the sheet bundle is larger.

14. The sheet post-processing apparatus according to claim 10, wherein said holding member holds the sheet bundle by sandwiching the sheet bundle between itself and a second holding member which is fixed.

15. The sheet post-processing apparatus according to claim 10, wherein said post-processing is processing for flattening a folded portion, including a fold line, of the sheet bundle subjected to folding.

16. The sheet post-processing apparatus according to claim 11, further comprising a detecting section configured to detect an amount of movement of said moving member, and wherein said control section starts processing for stopping said moving unit when said moving member has moved over a predetermined first distance, in a case where the number of sheets of the sheet bundle is not smaller than a predetermined number, and starts processing for stopping said moving unit when said moving member has moved over a predetermined second distance which is shorter than the predetermined first distance, in a case where the number of sheets of the sheet bundle is smaller than the predetermined number.

17. A method of controlling a sheet post-processing apparatus including a holding member configured to be used for holding a sheet bundle, a moving unit configured to move the holding member between a predetermined reference position and a predetermined holding position at which the holding member holds the sheet bundle, and a sheet post-processing unit configured to perform post-processing on the sheet bundle held by the holding member, the method comprising:

moving the holding member from the predetermined reference position using the moving unit; and decelerating a moving speed of the moving unit, before performing a stopping process for stopping the moving unit so as to position said holding member at the holding position, such that a deceleration rate of the moving speed is smaller as a thickness of the sheet bundle is larger.

18. A method of controlling a sheet post-processing apparatus including a holding member configured to be used for holding a sheet bundle, a moving unit configured to move the holding member between a predetermined reference position and a predetermined holding position at which the holding member holds the sheet bundle, and a sheet post-processing unit configured to perform post-processing on the sheet bundle held by the holding member, the method comprising:

moving the holding member from the predetermined reference position using the moving unit; and making timing of stopping the moving unit so as to position said holding member at the holding position later as a thickness of the sheet bundle is larger.

* * * * *